United States Patent [19]

Wilkening

[11] Patent Number: 4,706,647

[45] Date of Patent: Nov. 17, 1987

[54] AIR FLOW CONTROL FOR TOTALLY ENCLOSED FIREPLACE

[76] Inventor: Donald W. Wilkening, Akeley, Minn. 56433

[21] Appl. No.: 862,983

[22] Filed: May 14, 1986

[51] Int. Cl.[4] ..... F24C 15/10

[52] U.S. Cl. ..... 126/140; 126/202

[58] Field of Search ..... 126/77, 112, 121, 138, 126/139, 140, 193, 200, 202, 285 R, 288, 289, 290; 160/DIG. 9, 116; 49/504, 505; 16/DIG. 11

[56] References Cited

U.S. PATENT DOCUMENTS

| | | | |
|---|---|---|---|
| 2,707,946 | 5/1955 | Merryweather et al. | 126/140 |
| 2,814,287 | 11/1957 | Shults | 126/140 |
| 3,368,545 | 2/1968 | Ibbitson | 126/140 X |
| 3,459,173 | 8/1969 | Lydle | 126/138 X |
| 3,616,788 | 11/1971 | Hannebaum | 126/140 X |
| 4,329,930 | 5/1982 | Riley | 126/200 X |
| 4,355,625 | 10/1982 | Kincaid | 126/138 X |
| 4,519,377 | 5/1985 | Taylor | 126/140 X |

FOREIGN PATENT DOCUMENTS

| | | | |
|---|---|---|---|
| 1127031 | 7/1982 | Canada | 126/202 |

*Primary Examiner*—Margaret A. Focarino

*Attorney, Agent, or Firm*—Sturm & Baker, Ltd.

[57] ABSTRACT

An air flow damper-director control for admitting air to an enclosed fireplace cavity in fireplaces having a sealing enclosure over the cavity opening including a horizontally distributed aperture adjacent the bottom portion of a sealing enclosure and a vane rotatable about the lower extremity of the distributed aperture between a sealing closed position over the aperture and a plurality of positions permitting a variable air flow through the apertures while causing a lesser or greater proportion of the air flow to flow upwardly toward and along the inside of the enclosure or the interior of the fireplace cavity.

5 Claims, 8 Drawing Figures

AIR FLOW CONTROL FOR TOTALLY ENCLOSED FIREPLACE

BACKGROUND OF THE INVENTION

1. Field of the Invention

This invention relates generally to fireplace enclosures and is more particularly directed to a damper-director for controlling the flow of air to a fire inside of a fireplace from openings disposed in the fireplace enclosure.

2. Prior Art

The following is a listing of Prior Art Patents, the existence of which were determined in the course of a preliminary patentability search on the invention of this specification:

| Patent No. | Patentee | Issue Date |
|---|---|---|
| 4,519,377 | T. E. Taylor | May 28, 1985 |
| 4,446,848 | W. M. Becker et al | May 8, 1984 |
| 4,355,625 | W. C. Kincaid | Oct. 26, 1982 |
| 4,210,119 | D. P. Kincaid | Jul. 1, 1980 |
| 4,136,662 | A. C. Willson | Jan. 30, 1979 |
| 3,459,173 | J. E. Lydle | Aug. 5, 1969 |
| 3,457,907 | W. D. Brunig | Jul. 29, 1969 |
| 2,814,287 | I. N. Shults | Nov. 26, 1957 |
| 2,707,946 | G. Merryweather et al | May 10, 1955 |
| 2,135,899 | K. S. Jenson | Nov. 8, 1938 |

Of the above noted patents, the Shults U.S. Pat. No. 2,814,287 for DRAFT CONTROL shows an adjustable deflector utilized in conjunction with separate damper controls disposed over openings in the front of a fireplace enclosure and is used in such a manner that the deflector determines the direction of an air flow while the adjustable damper determines the quantity of air flow.

The Merryweather et al U.S. Pat. No. 2,707,946 for FIREPLACE FRONT OR FIXTURE shows a stationary deflector for determining the direction of an air flow from an adjustable damper which, in turn, determines the quantity of air flow through openings disposed in the front of the fireplace enclosure.

The Lydle U.S. Pat. No. 3,459,173 for FIREPLACE FRONT OR SCREEN shows a plurality of openings in the front of the fireplace front that are in communication with a chamber having, on one hand, a damper that permits air flow in one direction and a further deflector, that is always open, that deflects air in another direction.

The Prior Art described above and other forms of draft air controls may be seen to be unduly complicated from a structural standpoint or failing to accomplish the plurality of functions that have been discovered, by me, to be necessary to satisfy even the least picayune-ish fireplace aficionado.

My invention is most effective with fireplace enclosures incorporating doors having panels that are essentially transparent to radiant energy so that the heat associated with a fire inside of the fireplace is readily transmitted by radiation through a panel, such as various forms of glass that are designed to be radiation transmitting effective. The effectiveness of the transmission of radiant energy is vastly reduced by the presence of films formed from smoke or other products of combustion on the inside of such panels. Some of the Prior Art devices provide an air flow upwardly adjacent the interior surface of such panels and such arrangements provide for the air flow regardless of the quantity of draft air that is supplied to the interior of the fireplace and even though an adjustable deflector for such purposes may be present in the Prior Art, it must constantly adjusted for purposes as will be described below.

In connection with the volume or quantity of draft air that is supplied to a fire inside of a fireplace having an enclosure over the fireplace opening, I have discovered that the proportion of a total flow of any given amount that is directed upwardly over and adjacent to the interior surface of the transparent panels varies over a wide range such that when a low quantity of combustion air is required for the fire inside of the fireplace, a greater proportion of the total flow is required to "wash" the interior surface of the transparent panels while when a larger quantity is admitted to the interior of the fireplace a lesser proportion of the total flow is required for "washing" the interior surface of the transparent panels. This could be accomplished in, for example, the Shults patent referred to above, by continually adjusting the adjustable deflector mounted downstream of the damper. In addition, I have observed that the draft air admitted to a fireplace through the enclosure over the opening need not directed toward the bottom of the fireplace as the temperature of the draft air will cause it to flow toward the floor, or hearth of the fireplace and it will, at least in part, enter the combusting objects from the bottom of the fireplace. However, more importantly, with the use of the principles of my invention at a low draft air flow quantity, combustion is retarded, the fire becomes cooler and, even though inclined to generate smoke through incomplete combustion, the majority of the draft air flow is directed upwardly and adjacent to the inside of the transparent panels. When a large quantity of draft air is desired for increasing the combustion rate inside of the fireplace, some of the air will flow down to the hearth and upward through the fire, a majority will be directed toward the top of the fire above the combusting objects to complete the combustion process and reduce smoking and the like, while a smaller proportion is directed upwardly and over the interior surfaces of the enclosure panels.

SUMMARY OF THE INVENTION

My invention provides a novel, unobvious and uncomplicated combination of elements in which a single damper-director is used to control the quantity and direction of a flow of draft air to the interior of a fireplace through the front wall of a total enclosure. Between a closed position covering the openings in the front of the enolosure and a totally open position, there are an infinite number of combinations of air flows both in quantity and direction available through the operation of a single control member.

It is therefore an object of my invention to provide a continuous control of the quantity and direction of the flow of draft air into an enclosed fireplace. In one embodiment of my invention, a plurality of horizontally aligned apertures are disposed across the lower portion of a fireplace enclosure and a longitudinally elongated damper-director, or vane, is hingedly disposed at the lower ends of the apertures and extends thereacross so that when the top of the damper-director is adjacent the rear side of the fireplace enclosure the holes, or apertures, are closed off and when rotated inwardly about the hinge at the bottom, the flow and direction of flow are controlled by the use of a single actuator that is used to adjustably position the damper-director about its hinged connection.

DESCRIPTION OF THE INVENTION

Figure 1:
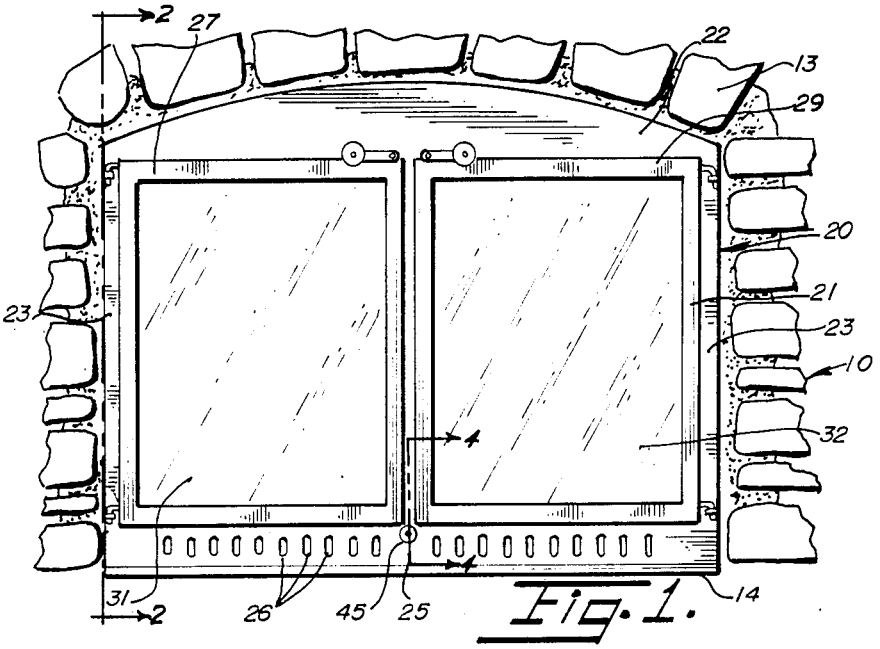
FIG. 1 is a front elevational view of a fireplace having an enclosure equipped with doors covering the fireplace opening.

Referring to the drawings in which like elements have been identified by like reference characters, FIG. 1 of the drawings shows a fireplace 10 having a firebox chamber 11 covered with an enclosure 20 having a pair of door frames 27 and 29.

Fireplace 10 is illustrated as having a firebox chamber 11, an upwardly opening throat 12, a face 13, a hearth, or floor 14, a smoke shelf 15 disposed at the bottom of a flue 16, and a grate 17 for receiving a quantity of combustible material, such as wood, 18, and a lintel 19 extending under the top, front surface of firebox chamber 11.

Fireplace enclosure 20 is illustrated in position at the front opening of firebox chamber 11 and includes a frame 21 having top, sides, center and bottom portions 22, 23, 24, and 25. Bottom portion 25 of frame 21 is provided with a plurality of horizontally spaced apart apertures, or openings 26. A pair of door frames 27 and 29 each having an inwardly extending seal member 28 and 30 and a transparent panel 31 and 32, respectively, are hingedly mounted on side portions 23 of frame 21 and are provided with suitable latching means for maintaining the door frames in a closed position. Reference may be made to my recently issued U.S. Pat. No. 4,515,146 for further details of the enclosure described above and illustrated in the drawings.

An air control in the form of a damper-director, or vane, 36 is shown comprised of a horizontally elongated rectangular member having an upwardly opening slot 37 at its central upper edge that is surrounded at its inwardly facing portion by a retainer member 38. The lower edge of damper-director 36 is hingedly mounted on the top 40 leaf of a hinge 39 of which the bottom leaf 41 is disposed on a similarly elongated rectangular member 42 disposed on the interior of bottom 25 on enclosure frame 21. An actuator 44, for adjustably rotating damper-director 36 about hinge 39, is shown disposed at the center of bottom portion 25 of frame 21 as comprised of a knob 45 disposed on the end of a threaded member 46 having a head 47 disposed on the inside of slot 37 and contained therein by "retainer" 38. Actuator 44 extends through a threaded member, such as a nut 48 attached to the front of bottom portion 25 of frame 21, and may be rotated to extend head 47 toward and away from bottom portion 25 to thereby rotate damper-director to varying positions between a closed position adjacent the inside face of bottom 25 of frame 21 and to a position of approximately 30° toward the interior of firebox 11.

OPERATION

Figure 2:
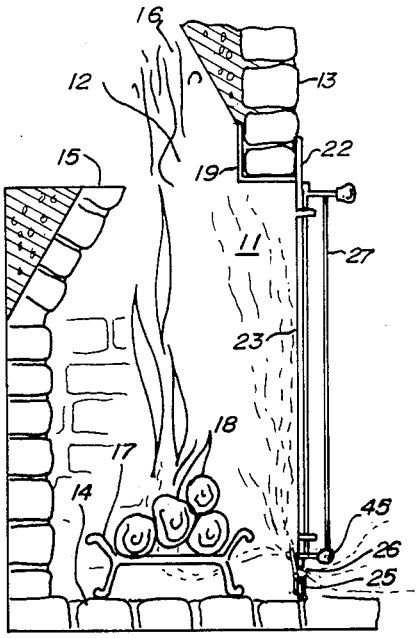
FIGS. 2 and 3 are side elevational views taken along section line 2—2 on FIG. 1 of the drawings.
Figure 3:
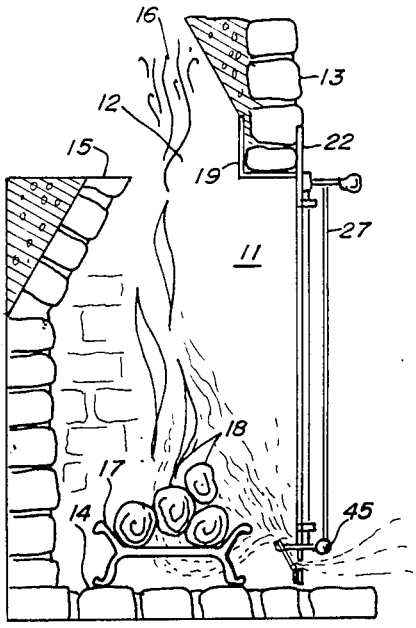
Figure 4:
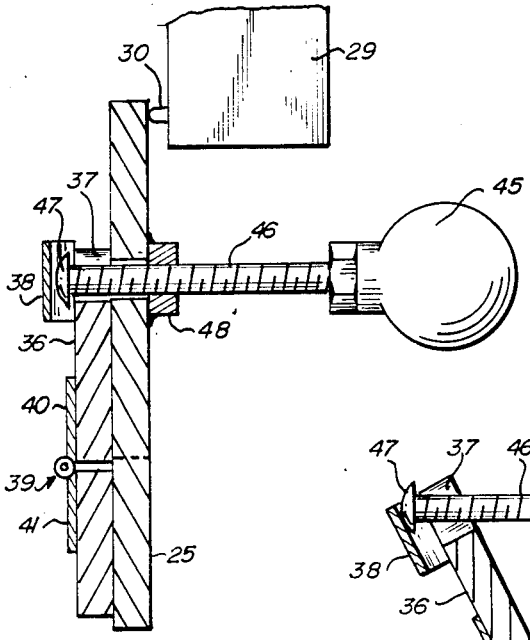
FIGS. 4 and 5 are enlarged, fragmentary sectional views showing my invention in two states of operation and taken along section lines 4—4 on FIG. 1 of the drawings.
Figure 5:
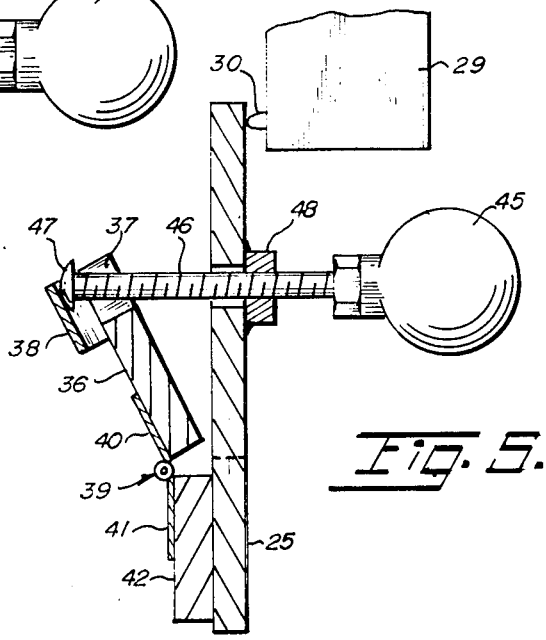
Figure 7:
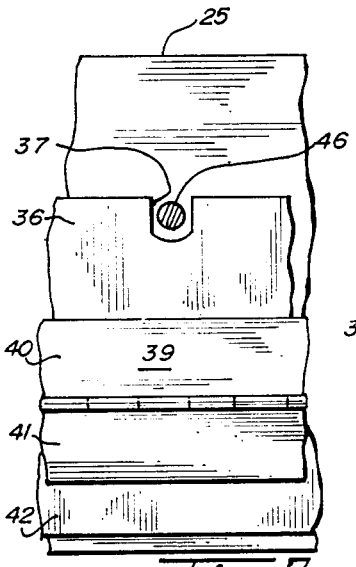
FIG. 7 is a similarly enlarged fragmentary view of a portion of FIGS. 1-6.
Figure 6:
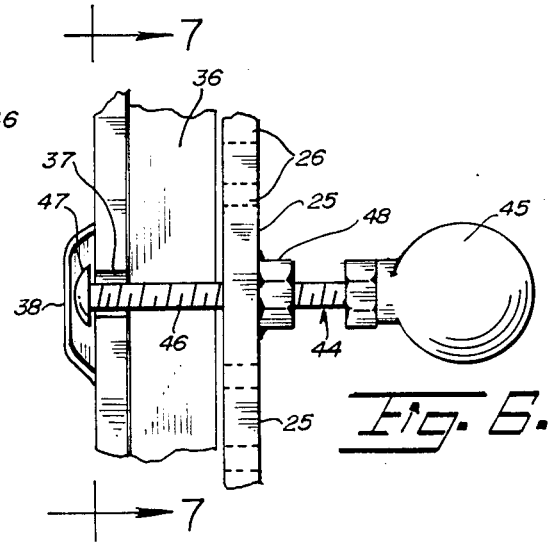
FIG. 6 is an enlarged fragmentary view looking down on FIGS., 4 and 5.
Figure 8:
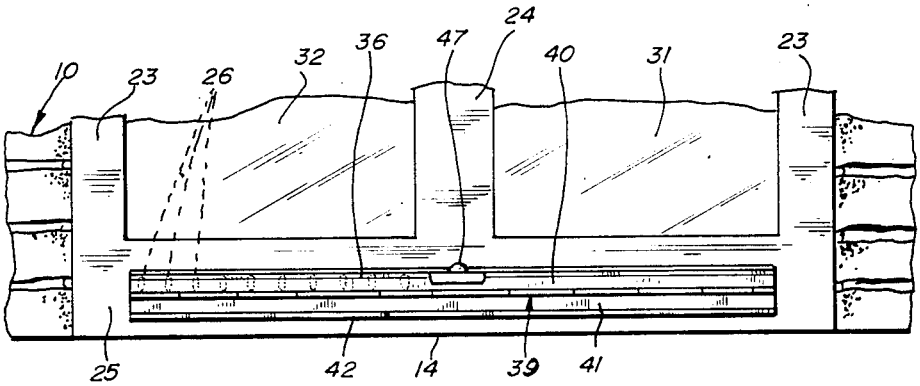
FIG. 8 is a fragmentary rear elevational view of the lower portion of FIG. 1.

As may now be understood and appreciated, the flow of draft air into a fireplace is adjustably, variably controlled through the co-action between damper-director, or vane 36 as it is rotated about hinge 39 on the inside bottom portion of the frame of enclosure 20, in relation to the horizontally distributed aperture, comprised of individual openings 26 horizontally spaced apart across the bottom 25 of enclosure 20. FIG. 4 illustrates a totally closed position; FIG. 5 illustrates an intermediate position and FIGS. 2 and 3 illustrate further positions with FIG. 2 illustrating a slightly open position and FIG. 3 illustrates a totally open position. FIGS. 2 and 3 also contain flow lines for an air flow to illustrate the difference obtained between the slightly open position and the totally open position.

Adjustment is accomplished by rotating knob 45 which will then cause rotation of threaded portion 46 in nut 48 disposed on bottom 25 of enclosure 20 and the enlarged head 47 disposed at the rear surface of slot 37 in damper-director 36 will move inwardly and outwardly and, since head 47 is captured between "retainer" member 38 and the rear surface of damper-director 36, the position thereof is governed by the position of head 47 and damper-director 36 is rotated about hinge 39 through a range of positions that is infinitely variable.

In one operative embodiment of my invention, it has been determined that an angle of 30° with respect to a vertical plane is sufficient to provide a proper draft for a fire while maintaining a suitable directional control for the flow of air for the totally open or widest position of admitting draft air.

Assuming that a fire, as illustrated in FIGS. 2 and 3, is burning in firebox 11 of fireplace 10 and that a user of the fireplace does not wish the fire to be extinquished for lack of draft-combustion air, and that further he desires a relatively cool, slow burning fire. If damper-director 36 had been closed, an adjustment to the position shown in FIG. 2 may be appropriate. Under the conditions of the position of damper-director 36 illustrated in FIG. 2, a lesser quantity of air will be admitted through apertures 26 and will flow in the proportion illustrated by the dotted lines emanating from the top of damper-director 36 such that the greater proportion of the air admitted and flowing to the interior of firebox 11 will flow substantially vertically upwardly and adjacent to the interior surfaces of transparent panels 31 and 32 and but a small proportion will flow downwardly and under grate 17 and onto the wood, or logs, 18 to sustain continued combustion. A portion of the air flow will move upwardly and toward the top of the flames emanating from logs 18 upwardly toward throat 12 of fireplace 10 and the products of combustion will be completely or substantially carried upwardly toward and into flue 16. The substantial portion of the air flow along the interior of panels 31 and 32 provides a protective layer of air that prevents any particles or gases from engagement with the interior surface and thereby prevents the deposition of a coating from condensation or the like and the panels are maintained in a clean condition.

When it is desired to obtain a hotter fire, and for purposes of illustration, damper-director 36 may be repositioned to its totally open position by rotation of knob 45 as is illustrated in FIG. 3 of the drawings whereat, again, the relative proportion of the flow of draft air is indicated by dotted lines as it proceeds through apertures 26 in bottom 25 on enclosure 20 and into firebox 11 on fireplace 10.

Particularly when a hotter fire is desired as by opening my damper-director to its wide open position as shown in FIG. 3, the direction of a majority of the draft air at the top of the fire and flames above the fuel results in a complete combustion of the gases generated in this portion of the volume of firebox 11 to provide an increase in the radiant energy emanating through the panels of the doors and the remainder of the products of combustion are swept upwardly through throat 12 to flue 16 of fireplace 10. It may further be noted that the increase in combustion above the fuel results in a draft through the fuel which will assist in providing a flow of a greater portion of the draft air to a position underneath grate 17 and thereby increase the rate of combustion of the fuel. This is indicated by the flow lines emanating from the upper end of damper-director 36 downwardly and under grate 17.

To summarize, draft air entering through apertures 26 moves generally in a horizontal direction and as it impinges upon damper-director 36, depending upon the angular disposition, is deflected upwardly toward throat 12 and, in varying degrees upon the inside surfaces of panels 31 and 32 or toward a flow beginning at the top of the products of combustion exhausting above the stack of fuel, 18. On the other hand, when damper-director 36 is in an almost closed position, as shown in FIG. 2, the flow of draft air from apertures 26 is deflected by damper-director 36 in an almost vertical stream which then tends to attach itself to the inside of panels 31 and 32 to form a barrier that will prevent flame, sparks or products of incomplete combustion, such as smoke, from impinging on the surfaces and the interior surfaces panels 31 and 32 will remain clean, thereby increasing the transmission of radiant energy through the panels to the room in which the fireplace is located while permitting the fire to burn at a lower rate to support continued combustion.

I claim:

1. In combination with a fireplace;

An openable sealing enclosure disposed over the front of a fireplace and having a plurality of horizontally spaced apart apertures disposed across the lower end and underneath the openable portion thereof; and a continuous, moveable air control vane sealably, hingeably attached to the inside of said enclosure adjacent the lower end of said apertures and rotatable horizontally about said hinge between a closed position adjacent the inside edges of said apertures and an open position extending angularly, upwardly and rearwardly of said apertures whereby air flowing through said apertures will predominantly flow upwardly along the rear of said enclosure when said air control is adjacent said apertures near said closed position.

2. The apparatus of claim 1 in which the open position of the vane is approximately 30° with respect to the vertical plane of the sealing enclosure.

3. In combination with a fireplace having a firebox chamber exhausting upwardly to a chimney and a front opening;

a sealing enclosure mounted over the front of the fireplace chamber of a fireplace including a horizontally distribued aperture adjacent the lower portion thereof; and an air damper-director comprised of a horizontally elongated rectangular vane rotatably disposed for rotation about its lower edge in registration with the lower portions of said aperture and adjusting means extending through the bottom of the sealing enclosure for engagement with the upper edge of said damper-director and disposed to be operable between a position sealing said aperture and a plurality of air directing positions for causing the principal air flow through the aperture to flow upwardly toward and along the inside of said enclosure in one position, and for causing the principal air flow to flow toward said fireplace chamber in another position, the principal air flow being directed variably intermediate said positions.

4. The apparatus of claim 3 in which the horizontally distributed apertures are comprised of a plurality of horizontally spaced-apart openings.

5. The apparatus as in any of claim 1, 3 or 4 in which the damper-director is operable between a closed position and an angle of approximately 30° with respect to the plane of the ceiling enclosure.

* * * * *